United States Patent [19]

Hiramatsu

[11] Patent Number: 4,936,566

[45] Date of Patent: Jun. 26, 1990

[54] APPARATUS FOR PICKING UP A PROPER NUMBER OF FABRIC WORKPIECES

[75] Inventor: Tooru Hiramatsu, Fuchu, Japan

[73] Assignee: Juki Corporation, Tokyo, Japan

[21] Appl. No.: 238,308

[22] Filed: Aug. 30, 1988

[30] Foreign Application Priority Data

Aug. 31, 1987 [JP] Japan ..... 62-218693

[51] Int. Cl.[5] ..... B65H 7/00

[52] U.S. Cl. ..... 271/90; 271/103; 271/108; 271/259; 271/260; 271/263; 73/37.7; 209/591; 414/797; 414/737

[58] Field of Search ..... 271/90, 96, 103, 105, 271/108, 258, 259, 260, 262, 263, 265; 414/797, 797.4, 797.8, 737, 752; 294/64.1; 73/1 R, 37.7, 38; 209/537, 591, 603, 604; 221/211

[56] References Cited

U.S. PATENT DOCUMENTS

| | | | |
|---|---|---|---|
| 3,749,220 | 7/1973 | Tabiichi et al. | 194/319 |
| 3,773,321 | 11/1973 | Burroughs | 271/260 |
| 3,778,051 | 12/1973 | Allen et al. | 271/262 |
| 4,098,408 | 7/1978 | Miller, Jr. et al. | 209/591 |
| 4,391,439 | 7/1983 | Edstrom | 271/263 X |
| 4,585,222 | 4/1986 | Nishibori et al. | 271/108 X |
| 4,608,856 | 9/1986 | Daly, Jr. | 73/37.7 |

*Primary Examiner*—Joseph J. Rolla
*Assistant Examiner*—Boris Milef
*Attorney, Agent, or Firm*—Morgan & Finnegan

[57] ABSTRACT

A method and an apparatus for picking up a fabric workpiece by applying vacuum provides two vacuum sensors; one for a sample fabric and the other for a fabric workpiece to be picked up. Where the apparatus has picked up incorrect number of sheets, the two vacuum sensors will output different voltages and the values are converted from analog to digital and input to a comparator. Thus, in such a case, the comparator outputs particular signals to stop the picking-up action of the apparatus.

5 Claims, 4 Drawing Sheets

APPARATUS FOR PICKING UP A PROPER NUMBER OF FABRIC WORKPIECES

BACKGROUND OF THE INVENTION

This invention relates to a method and apparatus for picking up fabric workpieces one by one from a pile of workpieces by applying vacuum and, more particularly, to detecting means to determine if the proper number of sheets have been picked up.

For the automation of sewing processes, workpiece conveyers which pick up a workpiece from a pile of workpieces and conveys it to the sewing section have been installed at many sewing factories. Such workpiece conveyers have been utilizing an apparatus which enables workpieces to be picked up one by one as shown in FIG. 4.

Referring to FIG. 4, one conventional type of apparatus for the picking up of a workpiece will be explained. Numerals 1, 2 denote vacuum pads connected to a vacuum source (not shown) and provide suction pipes 1*a*, 2*a*, respectively. Numeral 3 denotes an arm which carries the vacuum pads 1, 2. When a workpiece C1 is to be picked up from a pile 4, at first, the arm 3 descends in direction of arrow A such that the vacuum pads 1, 2 contact with a workpiece C1 and suctions the workpiece. Thereafter, the arm 3 ascends in direction of arrow B picking up the workpiece C1 from the pile 4. The arm 3 then moves in direction of C, D in succession to a photo sensor 5. The photo sensor 5 detects whether the vacuum pads 1, 2 have picked up the workpiece C1 and, if the photo sensor 5 detects the presence of workpiece C1, the arm 3 moves further in the direction of E, C in succession to a workpiece setting table (not shown). Then, by shutting off the vacuum line, the workpiece C1 separates from the vacuum pads 1, 2 and is positioned on the setting table.

In accordance with the aforementioned apparatus for picking up a workpiece, it is possible to detect whether or not workpiece is picked up but it is impossible to detect if only a single workpiece has been picked up. Generally, the workpieces are picked up one by one, but where the workpiece is very light and rarely woven, several workpieces may be picked up by suction.

To detect such mishandling, where a photo sensor is used, the sensitivity of the photo sensor is adjusted in accordance with the particular workpiece, especially with regard to color, transparency, thickness of the workpiece, etc., and so productivity is lowered. Additionally, to check by means of the photo sensor 5, the arm 3 must be moved more in direction of D, E so it takes more time and conveyer control is complicated.

SUMMARY OF THE INVENTION

With the foregoing in mind, it is an object of the present invention to provide an apparatus for picking up a workpiece that is capable of detecting whether the predetermined number of workpieces have been picked up, or whether the workpiece picked up is the one required.

According to the present invention, a first vacuum pad which picks up a workpiece from a pile of workpieces, and a second vacuum pad which picks up a sample fabric equivalent to said piled workpieces are connected. A first detecting means which detects the vacuum pressure in the first vacuum pad, and a second means which detects the vacuum pressure in the second vacuum pad are provided. A comparing means which compares whether the output from the first detecting means and the second detecting means are equivalent is provided.

When number of suctioned workpieces by the first vacuum pad is different from number of suctioned workpieces by the second vacuum pad, the vacuum pressure at the pads will be different and the output from the first detecting means will be different from the output from the second detecting means. As a result, the comparing means outputs a signal which indicates that the first vacuum pad picked up the wrong number of workpieces. Thereby, mishandling of workpieces is prevented.

BRIEF DESCRIPTION OF THE DRAWINGS

The accompanying drawings, referred to herein and constituting a part hereof, illustrate a preferred embodiment of the invention and, together with the description, serve to explain the principles of the invention, wherein.

DETAILED DESCRIPTION OF THE DRAWINGS

Figure 1:
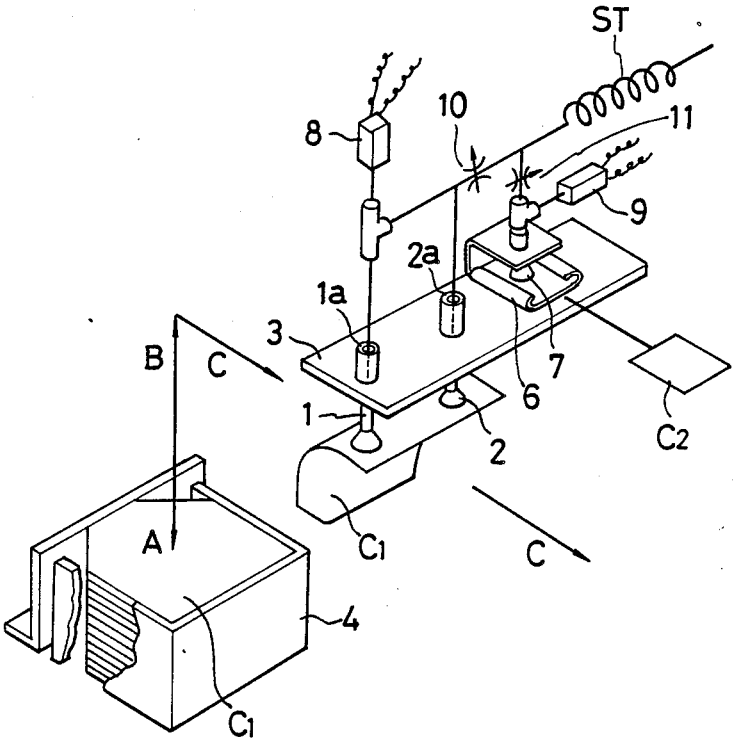
FIG. 1 is a perspective view of an apparatus for picking up a workpiece according to the present invention.
Figure 3:
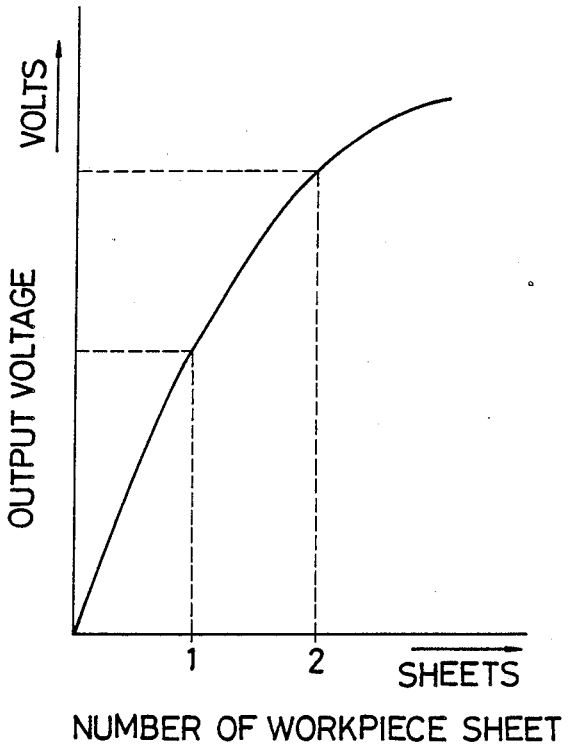
FIG. 3 is a graphical representation of output voltage vs. numbers of workpiece sheets picked up.
Figure 4:
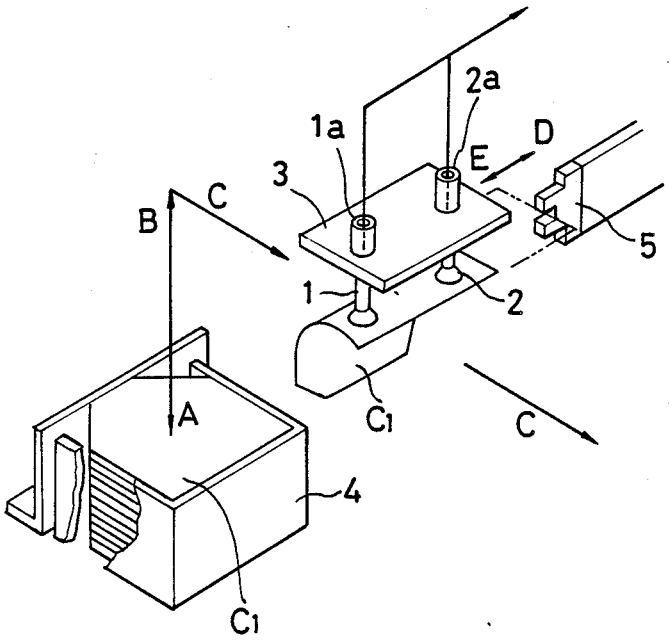
FIG. 4 (PRIOR ART)
FIG. 4 is a perspective view of an apparatus for picking up a workpiece according to the prior art.

Referring from FIG. 1 to FIG. 3, one preferred embodiment of the present invention will be explained hereinafter. The same numerals as shown in FIG. 4 will be applied throughout where parts are functionally equivalent, so further explanations are eliminated.

Numeral 6 denotes a sample-set table placed on an arm 3, and receives a sample fabric sheet which is cut at predetermined dimensions. The sample fabric sheet is the same as those in pile 4. Numeral 7 denotes a second vacuum pad which suctions a sample fabric sheet C2 placed on the sample-set table 6. The second vacuum pad 7 is connected to the same vacuum source as the first vacuum pads 1, 2. The configuration of the second vacuum pad 7 is same as the first vacuum pads 1, 2.

Numeral 8 denotes a vacuum sensor and is a first detecting means which detects the vacuum pressure at the first vacuum pad 1. Numeral 9 denotes a vacuum sensor and is a second detecting means which detects the vacuum pressure at the second vacuum pad 7. Each of numerals 10, 11 denotes a throttle valve and is located between the first vacuum pad 1 and the vacuum source, and the second vacuum pad 7 and the vacuum source, respectively. The throttle values 10, 11 each work as a buffer. Symbol ST denotes a flexible suction tube. Since the arm 3 is movable, a flexible tube is used.

Figure 2:
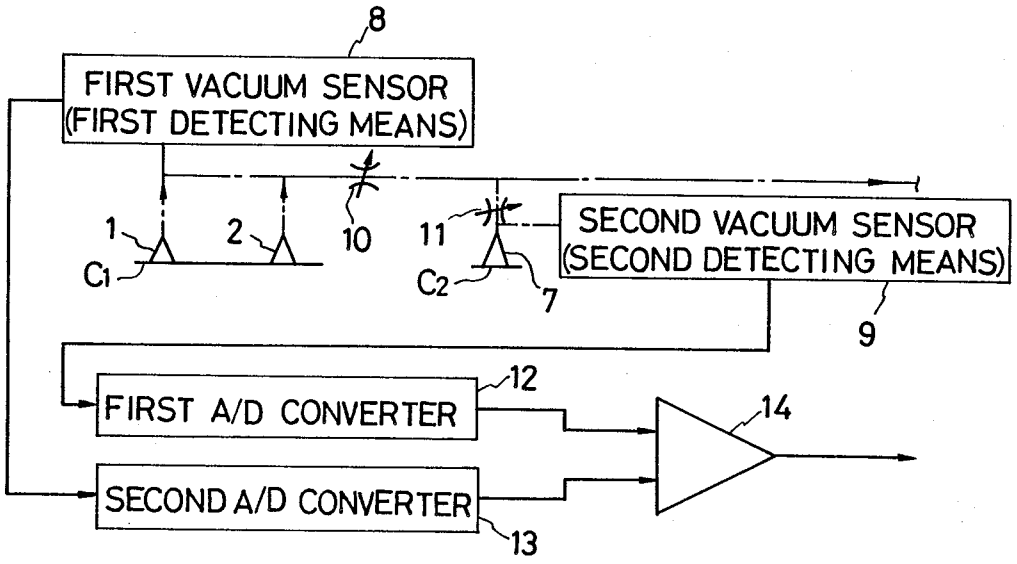
FIG. 2 is a block diagram of an electric circuit according to the invention.

Referring to FIG. 2, numeral 12 denotes a first A/D converter which converts the analog signal from the first vacuum sensor (first detecting means) 8 to a digital signal. Numeral 13 denotes a second A/D converter which converts the analog signal from the second vacuum sensor (second detecting means) 9 to a digital signal. Numeral 14 denotes a comparator which compares whether the digital signal from the A/D converter 12 and the digital signal from the A/D converter 13 are in accordance or not.

Under the aforementioned constitution, the operation of the present invention will be explained hereinafter. At first, the arm 3 descends in direction of arrow A in FIG. 1. The first vacuum pads 1, 2 touch with the workpiece C1 situated on top of the pile 4. The vacuum circuit works so the workpiece C1 is suctioned to the first pads 1, 2. The arm 3 ascends in direction of arrow B in FIG. 1, so that the workpiece C1 is picked up from the pile 4. Since the vacuum circuit already operated as set forth above, the second vacuum pad 7 suctions a sample fabric C2.

Vacuum pressure at the first vacuum pad 1 is detected by the first vacuum sensor (first detecting means) 8, its analog signal is converted to digital signal by the first A/D converter 12, and the signal is input to the comparator 14. Vacuum pressure at the second vacuum pad 7 is detected by the second vacuum sensor (second detecting means) 9, its analog signal is converted to digital signal by the second A/D converter 13, and the signal is input to the comparator 14. Referring to FIG. 3, if the first vacuum pad 1, 2 suctioned two sheets of workpiece C1, the analog signal value output from the first vacuum sensor (first detecting means) 8 will be larger than the analog signal value output from the second vacuum sensor (second detecting means) 9 as the vacuum sensors 8, 9 are so adapted. As one example of such a vacuum sensor, solid state pressure sensor (HONEYWELL 141PC15G) is applicable. Accordingly, the comparator 14 outputs a low-level signal, for instance an L signal, which represents that the output from the first vacuum sensor (first detecting means) 8 and the output from the second vacuum sensor (second detecting means) 9 are not in accordance.

The L signal is input to a control circuit (not shown) which controls the action of the arm 3 and other sewing processes. Thus, in such a case, the control circuit orders to stop the action of the arm 3 and consequent steps so that mishandling of the workpiece is prevented. Additionally, when the first vacuum pads 1, 2 have suctioned more than two sheets of workpiece, did not suction any sheets of workpiece, or suctioned different kinds of workpieces, the comparator 14 outputs an L signal and the sewing process stops.

When the first vacuum pads 1, 2 pick up one sheet of workpiece, the output signals from the first vacuum sensor 8 and the second vacuum sensor 9 will be in accordance, and so the comparator 14 outputs an H (high level) signal and the control circuit orders continued sewing. Thus, the arm 3 moves in direction of arrow C in FIG. 1 and conveys to the set-table.

The moving process of arm 3 is simpler since movement in the direction of E, D in FIG. 4 are eliminated, and so process time is shortened. According to the present invention, analog signals from the vacuum sensor 8, 9 are converted to digital and then compared, so the comparator is easily adapted to the apparatus.

While the invention has been described in its preferred embodiments, it is to be understood that the words which have been used are words of description, rather than limitation, and that changes may be made within the purview of the appended claims without departing from the true scope and spirit of the invention in its broader aspects. For example, the above description relates to the case of picking up one sheet of workpiece, but by adding additional numbers of sample sheets, it is possible to pick up two, three, or more sheets of workpiece as is required.

What is claimed:

1. An apparatus for picking up a proper number of fabric workpiece from a pile of workpieces, comprising:
   - a first vacuum device for picking up the workpiece, said first vacuum device being adapted to be connected to a vacuum source;
   - a second vacuum device for suctioning a sample workpiece same kind as the workpiece pile;
   - first vacuum detecting means for detecting vacuum pressure at said first vacuum device;
   - second vacuum detecting means for detecting vacuum pressure at said second vacuum device; and
   - comparing means for comparing whether the output from said first detecting means and from said second detecting means are in correspondence.

2. An apparatus for picking up a fabric workpiece as in claim 1, further comprising a movable arm for mounting said first vacuum device, said movable arm being movable between said pile of workpieces and a workpiece set-table.

3. An apparatus for picking up a fabric workpiece as in claim 1, wherein said first vacuum device includes multiple vacuum pads connected to the same vacuum source.

4. An apparatus for picking up a fabric workpiece as in claim 1, wherein said comparing means comprises a comparator which compares analog to digital converted output from said first detecting means and said second detecting means.

5. A method for picking up a proper number of fabric workpieces, comprising:
   - picking up a first fabric workpiece from a pile of workpieces by a first vacuum device and detecting a first vacuum pressure passing through said first fabric workpiece,
   - picking up a sample fabric workpiece from a set table by a second vacuum device and detecting a second vacuum pressure passing through said sample fabric workpiece, and
   - comparing said first vacuum pressure with said second vacuum pressure.

* * * * *